US005267431A

United States Patent [19]

Stahlecker et al.

[11] Patent Number: 5,267,431

[45] Date of Patent: Dec. 7, 1993

[54] SPINNING MACHINE HAVING SEVERAL SPINNING STATIONS FOR THE SPINNING OF YARNS FROM SLIVERS

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 850,301

[22] Filed: Mar. 12, 1992

[30] Foreign Application Priority Data

Mar. 20, 1991 [DE] Fed. Rep. of Germany ..... 4109098

[51] Int. Cl.[5] ..... D01H 13/04

[52] U.S. Cl. ..... 57/90; 226/171

[58] Field of Search ..... 57/90, 315; 226/171

[56] References Cited

U.S. PATENT DOCUMENTS

| | | | |
|---|---|---|---|
| 2,251,879 | 8/1941 | Akaboshi | 57/90 X |
| 2,623,346 | 12/1952 | Lohfert et al. | 57/315 |
| 2,746,236 | 5/1956 | Kufner | 57/315 X |
| 2,896,269 | 7/1959 | Gardella et al. | 57/315 X |
| 3,312,050 | 4/1967 | Noguera | 57/90 |
| 3,564,829 | 2/1971 | Tsuzuki | 57/90 X |
| 4,118,179 | 10/1978 | Ballinger | 226/171 X |

FOREIGN PATENT DOCUMENTS

| | | |
|---|---|---|
| 817572 | 10/1951 | Fed. Rep. of Germany . |
| 2335740 | 11/1974 | Fed. Rep. of Germany . |

*Primary Examiner*—Joseph J. Hail, III

*Attorney, Agent, or Firm*—Evenson, McKeown, Edwards & Lenahan

[57] ABSTRACT

In the case of a spinning machine for the spinning of yarns from slivers which are fed in cans, the slivers are guided from the cans to the spinning stations by guiding devices. The guiding devices comprise a drivable belt against which the sliver is pressed slightly by contact pressure elements. On one side, the belt is supported against a supporting device on the side facing away from the sliver.

20 Claims, 1 Drawing Sheet

Fig. 1
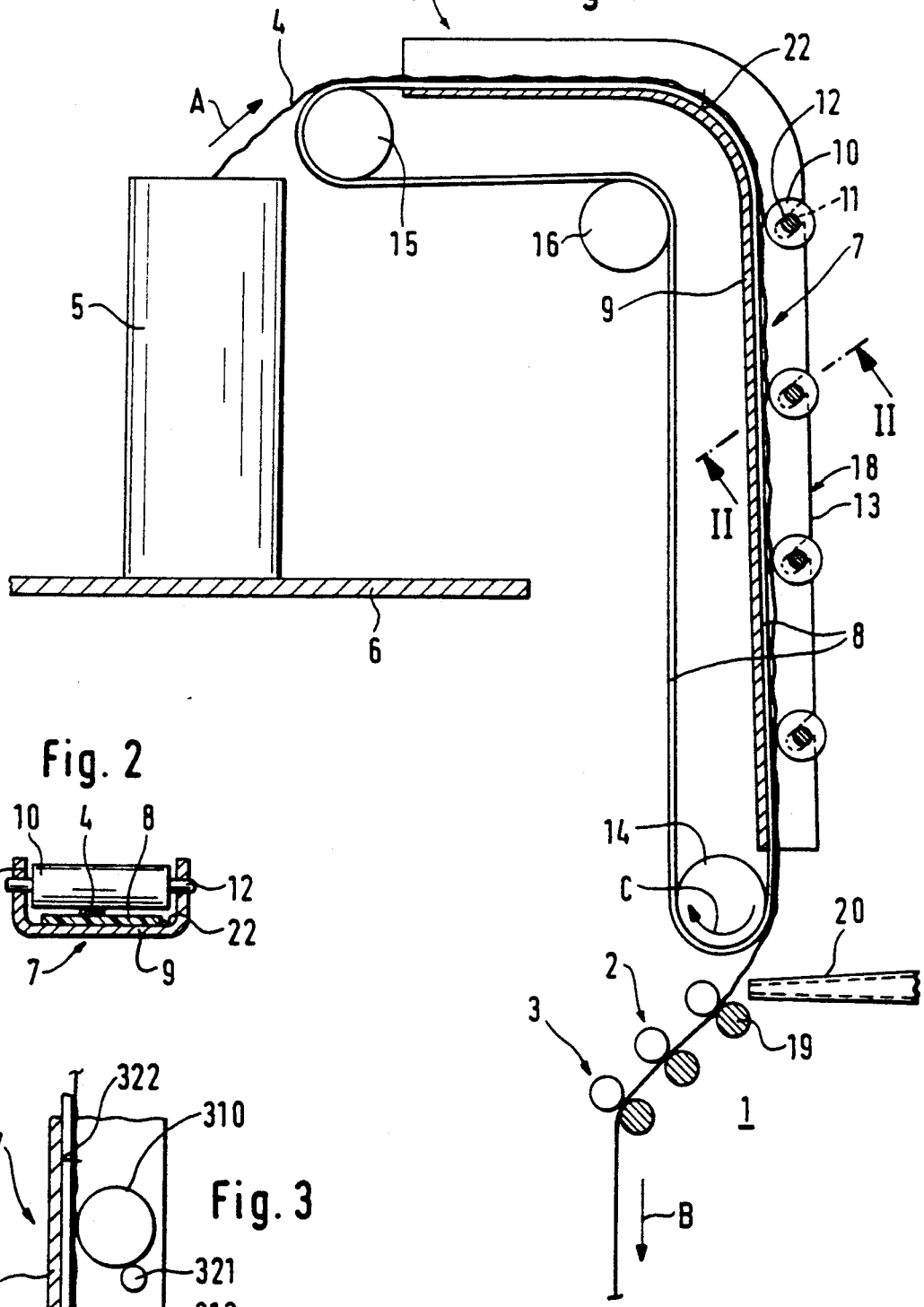
Fig. 2
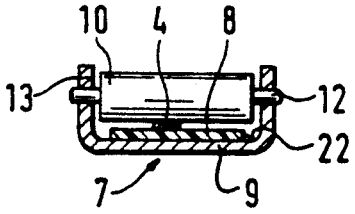
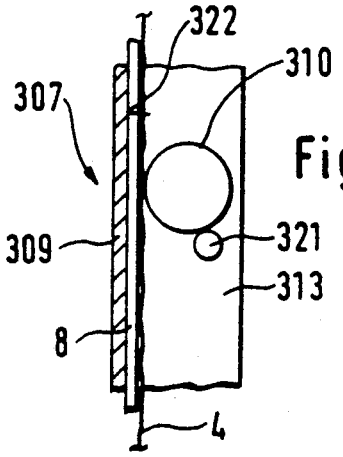
Fig. 3

SPINNING MACHINE HAVING SEVERAL SPINNING STATIONS FOR THE SPINNING OF YARNS FROM SLIVERS

BACKGROUND AND SUMMARY OF THE INVENTION

The invention relates to a spinning machine having several spinning stations for the spinning of yarns from slivers which are fed to the spinning stations in cans, guiding devices for the slivers being provided between the cans and the spinning stations.

The feeding of the fiber material to be spun in the form of slivers disposed in cans is known, for example, in the case of open-end spinning machines. In the case of the machines which are available on the market, the slivers are withdrawn directly by the sliver feeding device of the individual spinning stations from the cans disposed in front of and partly below the spinning arrangement.

It is also known (German Patent Document DE-C 23 35 740), in the case of open-end spinning machines, to arrange the cans on a platform above the spinning machine and to feed the slivers through guiding tubes to the spinning stations. These guiding tubes, which are provided with baffles, are to serve as an intermediate storage device which, on the basis of a special construction, is fed by a continuously running feeding device nevertheless intermittently. Then the sliver is to be guided through the respective guiding tube essentially without tensile stress.

The feeding of the fiber material in the form of slivers made available in cans is also known in the case of other fast-running spinning machines, such as wind-around spinning machines or air spinning machines. As a rule, these are one-sided machines, in the case of which the slivers withdrawn from the cans deposited on the rear side of the spinning machine are fed to the spinning stations from above. In this case, guiding devices for the slivers are provided in the form of pulleys and guide rods.

It is also known (German Patent Document DE-PS 817 572) to feed slivers in cans in the case of ring spinning machines, in which case the cans are deposited on platforms or in a space above the spinning machine. In this case, relatively long travelling paths are obtained with one or several vertical sections which lead to the risk that the slivers may hang out; that is, are drafted uncontrollably as a result of their own weight. Such an arrangement is therefore possible only for slivers which have a relatively coarse size and thus a relatively high strength.

However, the spinning of slivers of coarse sizes is very difficult on ring spinning machines. Since the ring spinning machines have only a relatively low delivery speed at the outlet of the drafting units, the feeding rollers of the drafting units—while the required drafting is taken into account—must run very slowly; that is, at rotational speeds of one revolution per minute and less. It is technically extremely difficult to let long shafts, like the feeding rollers of drafting units, run at such low rotational speeds with sufficient precision. There is the risk that these shafts will rotate only jerkily so that no controlled draft is obtained. The feeding of the fiber material to be spun in cans has therefore not been carried out successfully in practice in the case of ring spinning machines.

In an older German Patent Application (P 40 41 112.5, pA 1170, p 9342), which is no prior publication, it is suggested to provide guiding devices which support the slivers in the vertical direction and move along with the sliver. In this case, guiding aprons, which are driven in the transport direction and are supported against sliding surfaces, may be used as the devices for the guiding of the slivers. In this case, the sliver is guided between the guiding aprons and the sliding surfaces.

It is an object of the invention to develop a spinning machine of the initially mentioned type in such a manner that fine slivers may also be fed in cans without the risk of faulty drafts, particularly in vertical sections of the transport path.

This object is achieved in that the guiding devices comprise a drivable belt against which the sliver is slightly pressed by means of a contact pressure element, and which is supported against a supporting device on the side facing way from the sliver.

In the case of the development according to the invention, it is achieved that the slivers are supported and are nevertheless moved in the transport direction. As a result, it is possible to feed also relatively thin slivers in cans; that is, slivers of sizes of approximately Nm 0.4 to 0.8. In this case, these fine slivers may also be transported in the vertical direction along larger sections. It is therefore possible to carry out a can feeding also in the case of ring spinning machines because, on the basis of the slivers with the fine sizes, while taking into account the draft, the feeding roller pairs of the drafting units still run at a sufficiently high speed so that a uniform round rotating is ensured. By means of this can feeding, it will then be possible in the case of ring spinning machines to do without a premounted machine, specifically the flyer. In the case of other spinning machines, which are equipped with drafting units into which the slivers travel, it is possible to feed finer slivers so that then the drafting units may be simplified. For example, in the case of machines of this type, there is the possibility to use, instead of five-cylinder drafting units, the three-cylinder drafting units which are customary today in the case of ring spinning machines.

Also in the case of open-end machines, the feeding of finer slivers results in advantages because then the opening-up work for the separating of the fibers is reduced so that, during the opening-up, the fibers are processed more carefully. It is therefore possible to spin finer yarns with less damaged fibers so that the yarns have a higher quality.

In an advantageous development of the invention, the contact pressure element comprises a plurality of pressure rollers which are guided in connecting members and placed with a small force component against the sliver as a result of gravity. Advantageously, the supporting device comprises a sliding surface which can be slightly curved in the direction of the belt and against which the belt is placed.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial cross-sectional schematic view of a spinning machine constructed according to a preferred embodiment of the invention, in which case only the drafting unit of one side of the machine is shown to which a sliver is fed from a can deposited on a platform, the sliver being transported by a belt;

FIG. 2 is a view along the cross-sectional surface II—II of FIG. 1; and

FIG. 3 is a partial view similar to FIG. 1 of another development of the invention.

DETAILED DESCRIPTION OF THE DRAWINGS

In FIG. 1, only a drafting unit 2 of an individual spinning station 3 is shown of a spinning machine 1. However, such a spinning machine 1 comprises a plurality of such spinning stations 3 which are arranged in a row next to one another on one side of the machine or on both sides of the machine. A twist-providing machine, such as a ring spindle or a wind-around spindle or an air nozzle, which is not shown, connects to each drafting unit 2. Likewise, a sliver feeding device of an open-end spinning machine may be arranged at the point of the drafting unit 2 according to other contemplated embodiments. At each of these spinning stations 3, a sliver 4 is withdrawn from a can 5 and spun into a yarn.

In the embodiment according to FIG. 1, the cans 5 of the individual spinning stations 3 are disposed above the spinning machine 1 on a platform 6. The cans 5, which normally have an outside diameter which is larger than the spacing of the spinning stations (spacing of the spinning stations in the longitudinal direction of the machine) are deposited in several rows extending in the longitudinal direction of the spinning machine 1.

The slivers 4 are withdrawn in the direction of the arrow A upward from the cans 5 which are open on top and are then transported downward to the drafting units 2. In order to securely bridge this path also in the case of fine sizes of the slivers 4 without the occurrence of faulty drafts in the fine slivers 4, special guiding devices 7 are provided.

The guiding devices 7 comprise a circulating belt 8 which is supported against a sliding surface 22 of a supporting device 9. In the present case, the supporting device 9 is a component with a U-shaped cross-section which has a horizontal section 17 and a vertical section 18. The sliding surface 33 merges over into side walls 13.

The side walls 13 are used for the reinforcing of the supporting device 9 and are provided with connecting members 11 which are slightly sloped in the transport direction of the sliver 4. Several connecting members 11 are provided at larger distances. Lateral pins 12 of pressure rollers 10 which, because of gravity, rest slightly against the transported sliver 4, extend inside the connecting members 11.

In the area of the drafting unit 2, the belt 8 is deflected from its vertical direction back upwards by means of a driving disk 14 driven in the direction of the arrow C, is deflected by way of a deflection pulley 16 into the horizontal section 17 and, in the area of the upper opening of the pertaining can 5, by way of another deflection pulley 15, is deflected back in the opposite direction. A suction device 20 is situated in front of the feeding roller pair 19 of the drafting unit 2 into which the continuously fed sliver 4 is guided away in the case of an interruption in the drafting unit 2.

Instead of the connecting members 11, according to FIG. 3, stops 321 may also be provided in the lateral walls 313, for example, in the form of supporting pins or rollers. Also in the case of this embodiment, a belt 8 guiding the sliver 4 is placed against a sliding surface 322 of a supporting device 309 of the guiding devices 307 which has a U-shaped cross-section. The rollers 310 press the sliver 4 slightly against the belt 8 which, in turn, is supported on the sliding surface 322.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine comprising:
a plurality of spinning stations, and
sliver guiding devices for guiding sliver to the spinning stations from sliver supply cans,
wherein the guiding devices includes a drivable belt, a plurality of contact pressure elements spaced from one another along the sliver transport path of the belt for directly engaging the sliver and slightly pressing the sliver against the belt, and a belt supporting device disposed to support the belt on the side facing away from the sliver, said drivable belt and pressure elements operating to transport the sliver from the supply cans to the spinning stations without drafting of the sliver along the transport path thereof.

2. A spinning machine according to claim 1, wherein the supporting device comprises a sliding surface.

3. A spinning machine according to claim 2, wherein the sliding surface is curved toward the belt.

4. A spinning machine according to claim 3, wherein the contact pressure element is a pressure roller.

5. A spinning machine according to claim 4, wherein several pressure rollers are provided for each belt which are arranged above one another at a distance.

6. A spinning machine according to claim 5, comprising connecting members carried by the belt supporting device, wherein lateral walls, which comprise the connecting members, connect to the sliding surface.

7. A spinning machine according to claim 6, wherein the connecting members are sloped in the transport direction of the sliver.

8. A spinning machine according to claim 7, wherein the cans are arranged above the spinning stations on a platform.

9. A spinning machine according to claim 1, wherein the contact pressure element is a pressure roller.

10. A spinning machine according to claim 9, comprising a connecting member carried by the belt supporting device, wherein the pressure roller is provided with lateral pins which slide in the connecting member.

11. A spinning machine according to claim 10, wherein lateral walls, which comprise the connecting members, connect to the sliding surface.

12. A spinning machine according to claim 10, wherein a plurality of connecting members are provided, and wherein the connecting members are sloped in the transport direction of the sliver.

13. A spinning machine according to claim 9, wherein the pressure roller presses the sliver against the belt by means of a gravity component.

14. A spinning machine according to claim 13, wherein the pressure roller rests on a stop.

15. A spinning machine according to claim 9, wherein several pressure rollers are provided for each belt which are arranged above one another at a distance.

16. A spinning machine according to claim 15, wherein the pressure roller rests on a stop.

17. A spinning machine according to claim 9, wherein the pressure roller rests on a stop.

18. A spinning machine according to claim 17, wherein the stop is constructed as a supporting pin or roller which forms a narrowing point with the belt.

19. A spinning machine according to claim 1, wherein the cans are arranged above the spinning stations on a platform.

20. A spinning machine according to claim 1, wherein the belt is deflected from a horizontal section of the guiding device into a vertical section.

* * * * *